United States Patent [19]

Dewson

[11] Patent Number: 4,517,767

[45] Date of Patent: May 21, 1985

[54] MINE VENTILATION DOOR

[76] Inventor: Frederick J. Dewson, 66 Koloona Ave., Figtree, New South Wales, Australia, 2525

[21] Appl. No.: 444,897

[22] PCT Filed: Mar. 17, 1982

[86] PCT No.: PCT/AU82/00031

§ 371 Date: Nov. 15, 1982

§ 102(e) Date: Nov. 15, 1982

[87] PCT Pub. No.: WO82/03245

PCT Pub. Date: Sep. 30, 1982

[30] Foreign Application Priority Data

Mar. 18, 1981 [AU] Australia ..... PE8036
Nov. 4, 1981 [AU] Australia ..... PF1418

[51] Int. Cl.[3] ..... E06B 3/32
[52] U.S. Cl. ..... 49/464; 49/505
[58] Field of Search ..... 49/464, 505

[56] References Cited

U.S. PATENT DOCUMENTS

| | | | |
|---|---|---|---|
| 1,279,879 | 9/1918 | Klingberg | 49/505 X |
| 1,387,059 | 8/1921 | McAllister | 49/464 |
| 1,442,553 | 1/1923 | Wood | 49/464 X |
| 1,741,940 | 12/1929 | Jacobson | 49/505 X |
| 2,316,688 | 4/1943 | Haase | 49/464 |

FOREIGN PATENT DOCUMENTS

| | | | |
|---|---|---|---|
| 403260 | 6/1966 | Switzerland | 49/505 |

*Primary Examiner*—Kenneth Downey
*Attorney, Agent, or Firm*—Cushman, Darby & Cushman

[57] ABSTRACT

A doorway frame for use in underground passageways consists (FIGS. 2, 7) in spaced apart upright members (11,12) the length of each of which may be independently adjusted by an extension member (13,14), a clamp (15) for an adjusted length, and a head member 16 pivotally connected (17) to the upright members (11,12). For preference the doorway frame is provided with a door frame FIGS. (10–12) having removable modular slats (60) extending between upright channel members (51,52) and retained in slots (53) thereof.

9 Claims, 12 Drawing Figures

MINE VENTILATION DOOR

TECHNICAL FIELD

This invention relates to a frame for a doorway for use in closing an underground mine passage and to a ventilation door assembly for use with the frame.

BACKGROUND ART

In, for example, coal mines it is usual for the mining operation to form a network of spaced apart passages such as shown schematically in FIG. 1.

Typically a first passageway 1 is utilized to provide ventilation to the active mining face and a second passageway 2 is utilized to provide a ventilation return path from the face.

Cross passages 3 communicating between the first and second passageway are closed in order to improve the ventilation flows, but the closure 4 must include a door or trapdoor 5 openable to permit a man to pass therethrough in the event of an emergency.

Mine passages are not of uniform dimension, nor of uniform cross-section, and in fact are liable to change in cross-section as time passes due to floor heave or roof pressure. Therefore each doorway frame is presently individually constructed at the desired location from timber. Each of two timber pillars is first cut to approximate size, next wedged upright in place between the roof and the floor, and then doorway frame members are constructed and mounted to the pillars and a suitable door supported therefrom. The space between the doorway frame and the surrounding passage wall is then bricked up, or otherwise sealed. Typically each such construction involves 2 men for a day.

In addition it is sometimes desired to provide partial closure of a passageway to balance the ventilation system.

In that event it has been usual to partially close the passage with brick walls leaving an opening which in turn is partially closed by a cladding material for example by fibro cement or timber loosely nailed to battons. The sheets are arranged to leave an unclad opening having an area determined by aerodynamic measurement to provide balanced ventilation.

Each shift, inspectors are required to pass through the passage. To do so they must remove the cladding sheets and do not always return them to the correct position. The ventilation openings are the subject of regulations and if adjustable must be locked by mine management.

DISCLOSURE OF THE INVENTION

The present invention provides a doorway frame suitable for installation in a mine passageway and which in preferred embodiments may be prefabricated and may be installed in a very much shorter time than previous doorway frames.

According to a first aspect the invention consists in a doorway frame for installation in a mine passage and comprising:

- two upright members, one spaced apart from the other,
- means whereby the length of each upright member may be adjusted and then clamped, and
- a head member extending between the upright members and pivotally connected to each.

In preferred embodiments of the invention the doorway frame further comprises a substantially horizontal member connecting the lower end of one upright with that of the other.

Doorway frames according to the invention may be prefabricated and may be preassembled with or without a doorway hinged thereto or may be taken into the mine in kit form and assembled where required.

In a preferred embodiment, the doorway frame of the invention is provided with a door frame hinged thereto; each side of the door frame is provided with an upwardly extending "U" cross section channel of which the longitudinal opening of each faces the other, and the channels are adapted to receive modular slats or panels extending therebetween so that the slats or panels are stacked edge to edge and may be inserted or removed from the upper end of the channels to vary the area of the door frame which is clad thereby to adjust the unclad area which provides a ventilation passage.

BRIEF DESCRIPTION OF THE DRAWINGS

The invention will now be more particularly described by way of example only with reference to the accompanying drawings wherein.

PREFERRED EMBODIMENTS OF THE INVENTION

Figure 1:
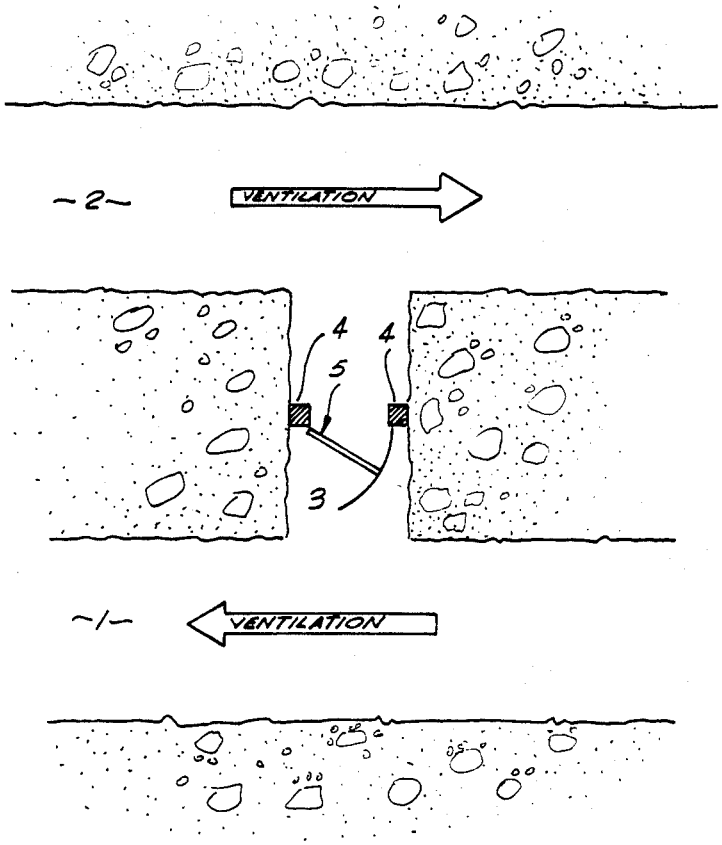
FIG. 1 is a schematic representation of a mine passageway.
Figure 2:
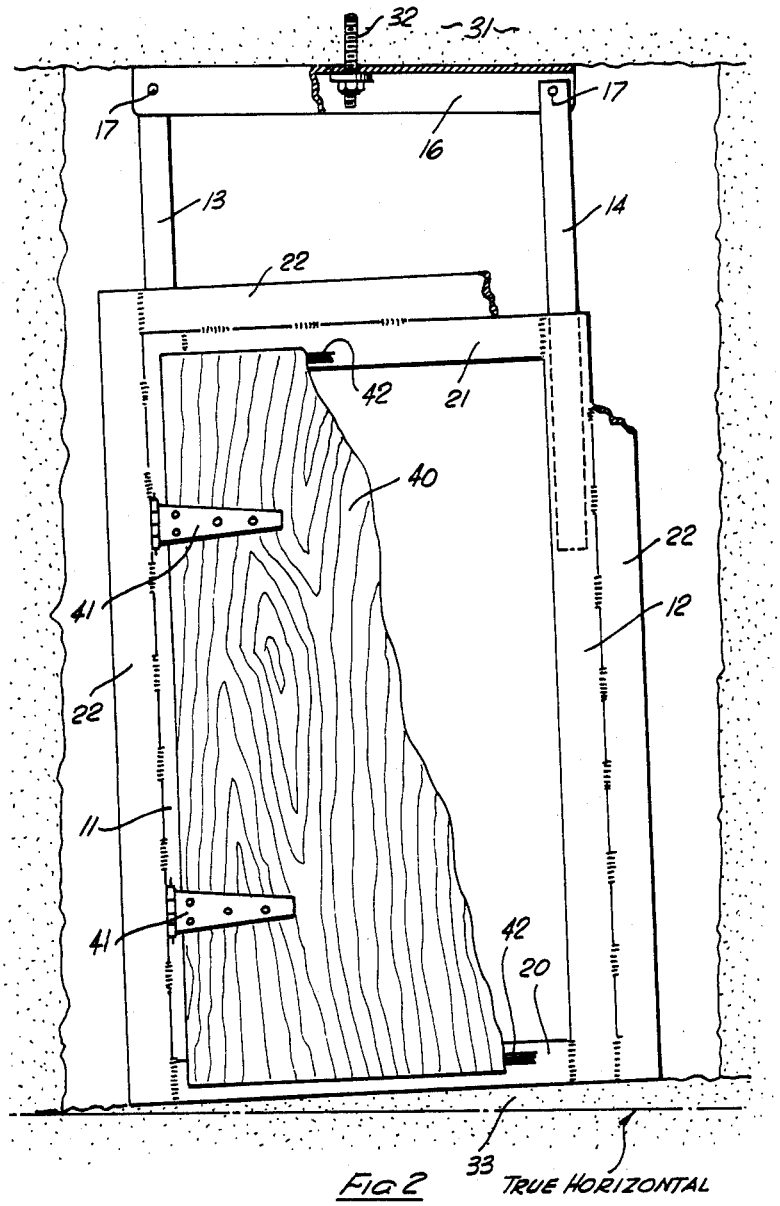
FIG. 2 shows in front elevation a first embodiment of a doorway frame according to the invention.

With reference to FIG. 2 there is shown an embodiment of a doorway frame according to the invention.

The doorway frame comprises a first upright member 11 and a second upright member 12.

In the present example members 11,12 are each hollow, tubular, of square cross section, and telescopically adjustable in length by means of a nested tubular upright extension member 13,14 respectively.

Figure 5:
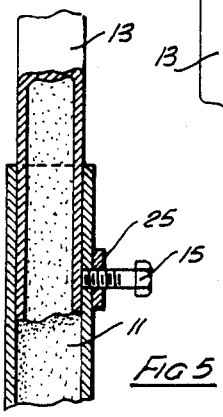

Clamping means 15 shown in more detail in FIG. 5 are provided so that after the length of upright member 11 (or 12) has been adjusted by extension or retraction of extension member 13 (or 14) the combination can be clamped and held at the desired length.

Figure 4:
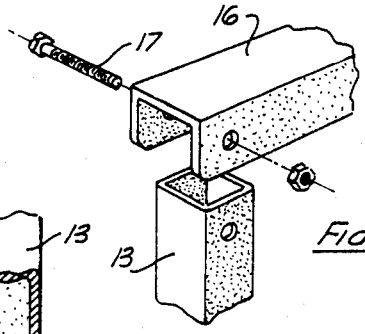

A transverse head member 16 extends between upright extension members 13 and 14 and is pivotally connected with each by bolts 17 as shown in FIG. 4.

In the case of a man door the doorway frame may be provided with cross members 20,21 so that members 11, 12, 20, 21 function as a door jamb assembly and members 13, 16, 14 may be considered as a head frame assembly.

Figure 6:
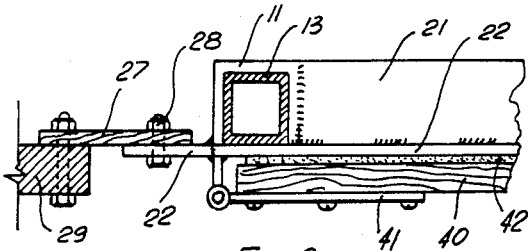
FIG. 6 shows in plan view the embodiment of FIG. 2.

With reference to FIG. 6 the door jamb assembly members may be provided with flanges 22 to which timber battens 27 may be attached by screws 28 to facilitate finishing off when the space between the doorway assembly and surrounding coal rib is sealed with brick or plaster 29.

Figure 3:
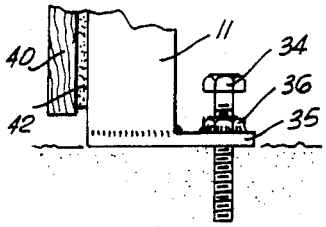
FIGS. 3, 4, 5 show in detail portions of the embodiment of FIG. 2.

As an example of installation, the door jamb assembly may first be installed in place and may be anchored to the passage floor 33, for example by means of a bolt 34 passing through a foot 35 in threaded engagement with a nut 25 welded to the foot (as shown in FIG. 3) and desirably provided at the base of each upright member 11, 12.

Figure 7:
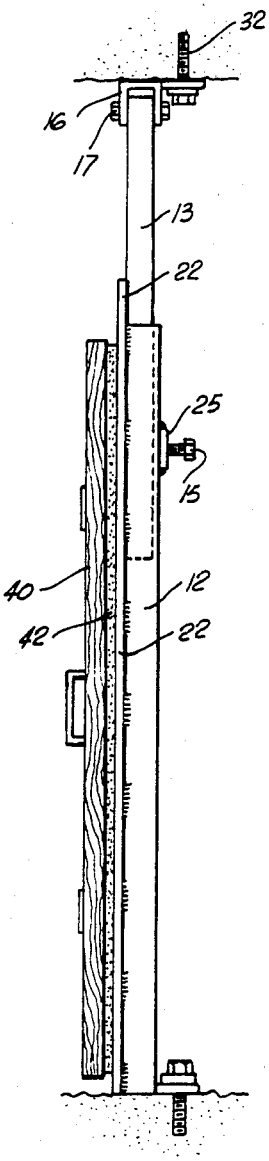
FIG. 7 shows in side elevation the embodiment of FIG. 2.

With clamps 15 loosened, the head frame is then raised and head member 16 secured to roof 31 for example by means of a roof bolt 32 (FIG. 7).

Clamps 15 are then used to clamp the head frame with respect to the door jamb frame. The surrounding passageway may then be closed off.

A doorway 40, for example an 18 mm thick plywood doorway, may then be mounted by means of hinges 41 to a door jamb 11. For preference door 40 is provided with a rubber perimeter seal 42 as shown in FIG. 9.

As shown in FIG. 5 the clamping means comprises a bolt 15 extending in threaded engagement through a nut 25 welded to member 11 and piercing member 11 to bear against the nested extension member 13.

Figure 8:
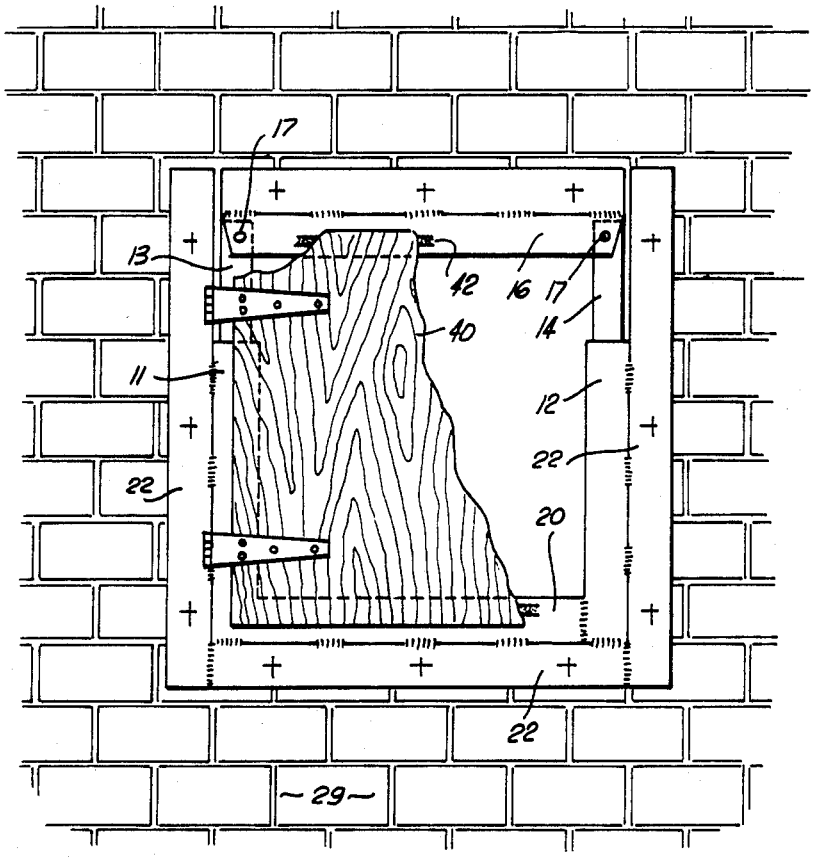
FIG. 8 shows a second embodiment of the invention in front elevation.
Figure 9:
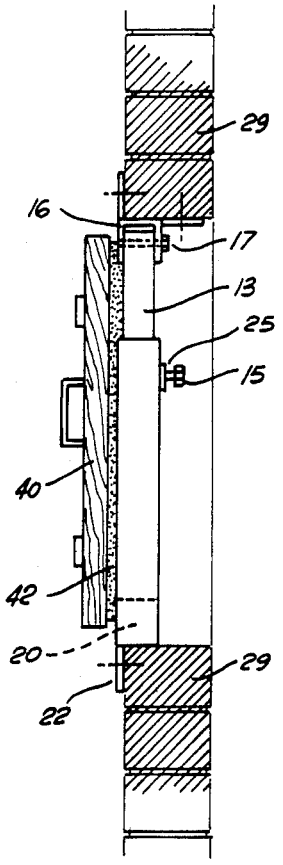
FIG. 9 shows the embodiment of FIG. 8 in side elevation.

Another embodiment of the invention shown in FIG. 8 and FIG. 9, is especially suitable for use when a trapdoor is to be provided. Numerals used to identify parts in FIGS. 2 to 7 are used to identify corresponding parts in FIGS. 8 and 9.

In the embodiment of FIGS. 8 and 9 doorway upper transverse jamb member 22 is in the form of an angled flat plate adapted to finish to a brick course.

If desired a return spring may extend between the doorway frame and a door hinge mounted therein.

Embodiments of the invention may be removed, and reused elsewhere, if desired. The frame may be mounted on packing if it is desired to increase the door-to-roadway floor clearance.

As will be apparent to those skilled in the art the invention provides a structure which can be positioned to take advantage of existing roof bolts.

The frame does not require either the floor or the roof to be level, and provides for adjustment to suite variation in roof height or to accommodate stress resulting from heave. The seal between door assembly and passage walls may be achieved by conventional or other methods.

Flat plates 22 are not essential and may be eliminated or replaced with mounting lugs.

Other means for extending the upright frame members may be substituted, for example, threaded cooperating parts, and other means for clamping the extended parts together for example bolts and boltways may be employed without departing from the inventive concept hereof.

If desired standard and interchangeable doors may be used.

In a preferred embodiment a doorway frame such as described above has ventilation door hinge mounted to the doorway frame.

Figure 10:
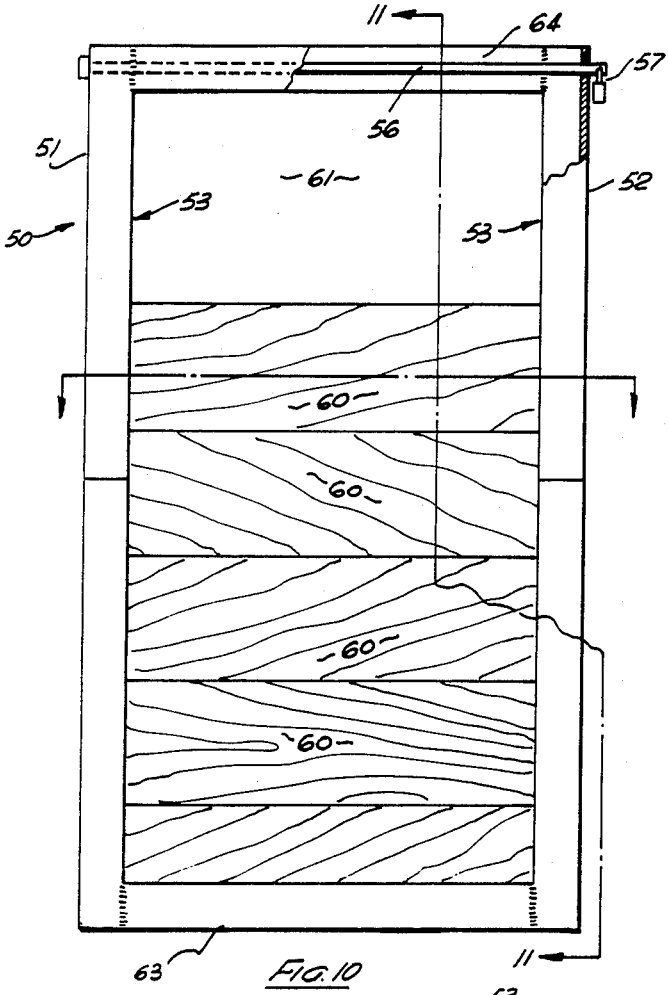
FIG. 10 shows a front elevation of a door frame for use in a doorway frame according to the embodiment of FIG. 2 or FIG. 8.
Figure 11:
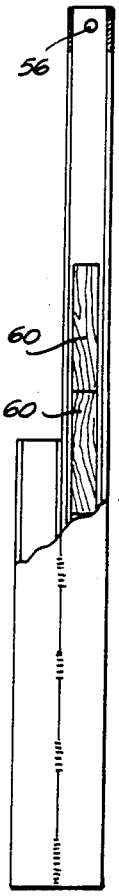
FIG. 11 shows a side elevation of the door frame of FIG. 10.
Figure 12:
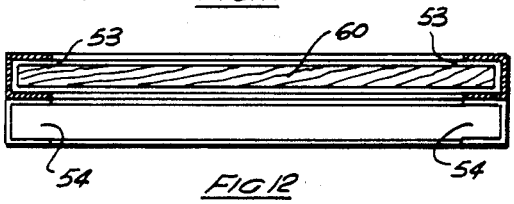
FIG. 12 shows a plan cross section of the door frame of FIG. 10.

With reference to FIGS. 10–12, the ventilation door comprises a door frame 50 to be hinge mounted to a doorway frame by hinge means (not shown).

Door frame 50 comprises two upright sides 51 and 52 joined at the lower edge by a cross bar 63 and at the top edge by a cross bar 64.

Upright sides 51 and 52 each have a first "U" cross section channel of which the open longitudinal slot 53 of one faces the open slot 53 of the other and extending substantially from the lower to the upper edge of door frame 50. The lower end of each channel is closed and the upper end open. For preference a second pair of "U" cross-section channel 54 is adjacent the first but extends from the lower edge to about the midheight of the door.

A plurality of slats or panels 60 are provided and one or more may be entered into channel slots 53 one after another and are adapted to extend between sides 51 & 52 and to be retained by the channels in edge to edge stacking relationship so as to clad a part of the area bounded by frame 50 and to leave unclad a portion 61 of the area to serve as an air passage. Spare panels may be stored by being stacked between second channel 54 in a similar manner.

A locking bar 56 is provided to prevent unauthorized removal of panels from slots 53. Locking bar 56 extends through apertures in sides 51 and 52 and is provided with locking means for example a padlock hasp 57 and staple.

The claims defining the invention are as follows:

I claim:

1. A door frame in combination with a doorway frame, said doorway frame comprising:

two upright members spaced apart from each other;

means for selectively adjusting the length of each upright member, and then for clamping said adjusted length; and a head member extending between said upright members and pivotally connected to each; wherein said door frame is hingedly mounted to said doorway frame, and comprises at each side an upwardly extending channel having a "U" shaped cross-section, said channels having facing longitudinal openings and being open at their upper end, said channels for receiving side edges of slats or panels extending there between and stacked in top-edge to bottom-edge relationship.

2. A door frame in combination with a doorway frame according to claim 1, further comprising:

a plurality of panels extending between said channels of said door frame in stacked relationship so as to partially clad said door frame.

3. A door frame in combination with a doorway frame according to claim 1, further including:

locking means to prevent unauthorized insertion or removal of slats or panels from said channels.

4. A door frame in combination with a doorway frame according to claim 1, said door frame further including:

a second pair of facing "U" cross-section channels adapted to store slats or panels.

5. A doorway frame for installation in a mine passage, comprising:

two upright members spaced apart from each other;

means for selectively adjusting the length of each upright member, and then for clamping said adjusted length;

means for securing a head member to a roof portion of said mine passage, said head member extending between said upright members and having means for pivotally connecting to said members to thereby facilitate said installation of said doorway frame in said mine passage.

6. A doorway frame according to claim 5, wherein; the upright members are telescopically adjustable in length.

7. A doorway frame according to claim 6, wherein: said means for clamping said upright members at an adjustable length comprises a lock bolt.

8. A doorway frame according to claim 5, further comprising:

a flange extending laterally from the upright members.

9. A doorway frame according to claim 5, further comprising:

a doorway or trapdoor hinge mounted thereto.

* * * * *